US009283591B2

(12) United States Patent
Wilson

(10) Patent No.: US 9,283,591 B2
(45) Date of Patent: Mar. 15, 2016

(54) REFRIGERATOR APPLIANCE AND METHOD FOR USE WITH SINGLE SERVE DISPENSER

(71) Applicant: General Electric Company, Schenectady, NY (US)

(72) Inventor: Mark Wayne Wilson, Simpsonville, KY (US)

(73) Assignee: General Electric Company, Schenectady, NY (US)

( * ) Notice: Subject to any disclaimer, the term of this patent is extended or adjusted under 35 U.S.C. 154(b) by 93 days.

(21) Appl. No.: 14/060,666

(22) Filed: Oct. 23, 2013

(65) Prior Publication Data

US 2015/0107460 A1 Apr. 23, 2015

(51) Int. Cl.

| | |
|---|---|
| ***A47J 31/06*** | (2006.01) |
| ***B05C 15/00*** | (2006.01) |
| ***F25D 3/11*** | (2006.01) |

(52) U.S. Cl.

CPC .. *B05C 15/00* (2013.01); *F25D 3/11* (2013.01)

(58) Field of Classification Search

CPC ..... B05C 15/00
USPC ..... 222/146.6, 146.1, 129.1; 99/295
See application file for complete search history.

(56) References Cited

U.S. PATENT DOCUMENTS

| | | | | |
|---|---|---|---|---|
| 7,644,650 | B2 | 1/2010 | Suzuki | |
| 2003/0145736 | A1 * | 8/2003 | Green | 99/280 |
| 2007/0062972 | A1 * | 3/2007 | Feldman et al. | 222/129.1 |
| 2009/0293735 | A1 * | 12/2009 | Van Dillen et al. | 99/295 |

FOREIGN PATENT DOCUMENTS

KR 20040085755 A 10/2004

* cited by examiner

*Primary Examiner* — Donnell Long
(74) *Attorney, Agent, or Firm* — Dority & Manning, P.A.

(57) ABSTRACT

Refrigerator appliances for use with single serve dispensers, and methods for operating refrigerator appliances, are provided. A refrigerator appliance includes a cabinet defining a chilled chamber for receiving food or beverage items for storage, the cabinet defining an opening for accessing the chilled chamber, and a door mounted to the cabinet at the opening of the cabinet, the door defining a dispenser recess. The refrigerator appliance further includes a dispensing assembly. The dispensing assembly includes an outlet conduit configured for flowing a liquid therefrom, the outlet conduit disposed in the dispenser recess, and a housing for supporting the single serve dispenser, the housing disposed in the dispenser recess. One of the outlet conduit and the housing is movable along a direction towards the other of the outlet conduit and the housing.

9 Claims, 6 Drawing Sheets

REFRIGERATOR APPLIANCE AND METHOD FOR USE WITH SINGLE SERVE DISPENSER

FIELD OF THE INVENTION

The present subject matter relates generally to refrigerator appliances, and more particularly for methods and apparatus for single serve dispenser use in refrigerator appliances.

BACKGROUND OF THE INVENTION

Certain refrigerator appliances include a dispenser for directing ice from the refrigerator's ice maker and/or liquid water to the dispenser. A user can activate the dispenser to direct a flow of ice or liquid water into a cup or other container positioned within the dispenser. Liquid water directed to the dispenser is generally chilled or at an ambient temperature.

Further, certain refrigerator appliances can also include features for dispensing heated liquid water. The heated liquid water can be used to make certain beverages, such as coffee or tea. Refrigerators equipped to dispense heated liquid water can assist with making such beverages. In some cases, however, users may desire only, for example, a single serving of a beverage, such as a hot beverage.

Accordingly, a refrigerator appliance which included features for dispensing single serve beverages would be desired. In particular, methods and apparatus for dispensing single serve beverages from refrigerator appliances would be advantageous.

BRIEF DESCRIPTION OF THE INVENTION

In accordance with one embodiment of the present disclosure, a refrigerator appliance for use with a single serve dispenser is disclosed. The refrigerator appliance includes a cabinet defining a chilled chamber for receiving food or beverage items for storage, the cabinet defining an opening for accessing the chilled chamber, and a door mounted to the cabinet at the opening of the cabinet, the door defining a dispenser recess. The refrigerator appliance further includes a dispensing assembly. The dispensing assembly includes an outlet conduit configured for flowing a liquid therefrom, the outlet conduit disposed in the dispenser recess, and a housing for supporting the single serve dispenser, the housing disposed in the dispenser recess. One of the outlet conduit and the housing is movable along a direction towards the other of the outlet conduit and the housing.

In accordance with another embodiment of the present disclosure, a method for operating a refrigerator appliance is disclosed. The method includes providing a single serve dispenser in a housing, the housing disposed in a dispenser recess defined in the refrigerator appliance. The method further includes moving one of the housing or an outlet conduit such that the outlet conduit contacts the single serve dispenser, and flowing a liquid from the outlet conduit into the single serve dispenser.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
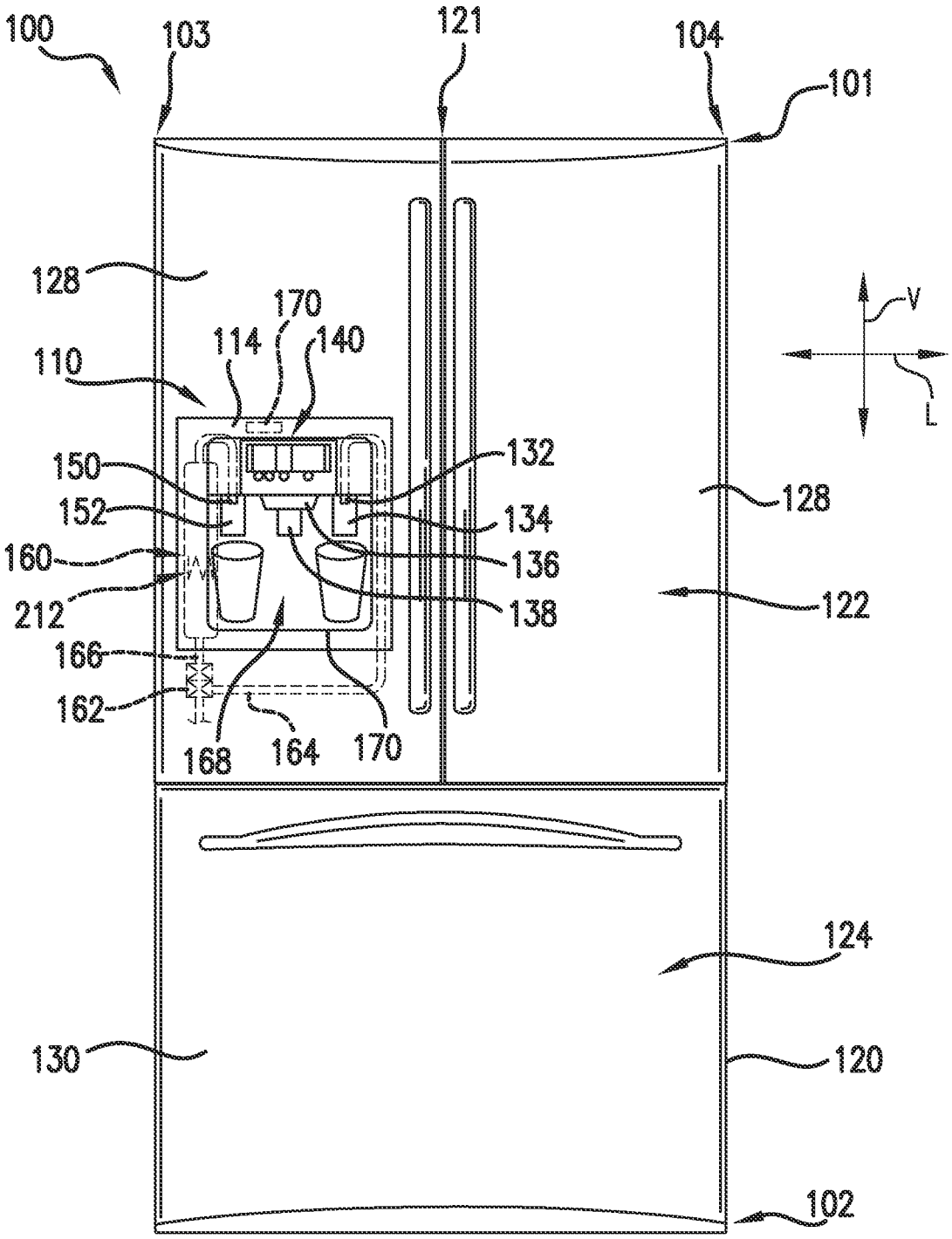
FIG. 1 provides a front, elevation view of an exemplary refrigerator as may be used with the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of a refrigerator appliance 100 according to an exemplary embodiment of the present subject matter. Refrigerator appliance 100 includes a cabinet or housing 120. Housing 120 extends between an upper portion 101 and a lower portion 102 along a vertical direction V and also extends between a first side portion 103 and a second side portion 104 along a lateral direction L. A transverse direction T (see FIGS. 3-6) may additionally be defined perpendicular to the vertical direction and lateral direction L. Housing 120 defines chilled chambers, e.g., a fresh food compartment 122 positioned adjacent upper portion 101 of housing 120 and a freezer compartment 124 arranged at lower portion 102 of housing 120. Housing 120 also defines a mechanical compartment (not shown) for receipt of a sealed cooling system for cooling fresh food compartment 122 and freezer compartment 124.

Refrigerator appliance 100 is generally referred to as a bottom mount refrigerator appliance. However, it should be understood that refrigerator appliance 100 is provided by way of example only. Thus, the present subject matter is not limited to refrigerator appliance 100 and may be utilized in any suitable refrigerator appliance. For example, one of skill in the art will understand that the present subject matter may be used with side-by-side style refrigerator appliances or top mount refrigerator appliances as well.

Refrigerator doors 128 are rotatably hinged housing 120, e.g., at an opening 121 that permits access to fresh food compartment 122, in order to permit selective access to fresh food compartment 122. A freezer door 130 is arranged below refrigerator doors 128 for accessing freezer compartment 124. Freezer door 130 is mounted to a freezer drawer (not shown) slidably coupled within freezer compartment 124.

Refrigerator appliance 100 may also include a dispensing assembly 110 for dispensing various liquids, such as liquid water and/or ice to a dispenser recess 168 defined on one of refrigerator doors 128. Dispensing assembly 110 includes a dispenser 114 positioned on an exterior portion of refrigerator appliance 100. Dispenser 114 includes several outlets for accessing ice, chilled liquid water, and heated liquid water. As will be understood by those skilled in the art, liquid water from a water source, such as a well or municipal water system, can contain additional substances or matter. Thus, as used herein, the term "water" includes purified water and solutions or mixtures containing water and, e.g., elements (such as calcium, chlorine, and fluorine), salts, bacteria, nitrates, organics, flavor additives and other chemical compounds or substances.

To access ice, chilled liquid water, and heated liquid water, water-dispensing assembly 110 may for example include a chilled water paddle 134 mounted below a chilled water outlet 132 for accessing chilled liquid water and a heated water paddle 152 mounted below a heated water outlet 150 for accessing heated liquid water. Similarly, an ice paddle 138 is mounted below an ice outlet 136 for accessing ice. As an example, a user can urge a vessel such as a cup against any of chilled water paddle 134, heated water paddle 152, and/or ice paddle 138 to initiate a flow of chilled liquid water, heated liquid water, and/or ice into the vessel within dispenser recess 168, respectively.

A control panel or user interface panel 140 may be provided for controlling the mode of operation of dispenser 114, e.g., for selecting crushed or whole ice. In additional exemplary embodiments, refrigerator appliance 100 may include a single outlet and paddle rather than three separate paddles and dispensers. In such embodiments, user interface panel 140 can include a chilled water dispensing button (not labeled), an ice-dispensing button (not labeled), a heated water dispensing button (not labeled), and a steam-dispensing button (not labeled) for selecting between chilled liquid water, ice, heated liquid water, and steam, respectively.

Outlets 132, 136, and 150 and paddles 134, 138, and 152 may be an external part of dispenser 114, and are positioned at or adjacent dispenser recess 168, e.g., a concave portion defined in an outside surface of refrigerator door 128. Dispenser 114 is positioned at a predetermined elevation convenient for a user to access ice or liquid water, e.g., enabling the user to access ice without the need to bend-over and without the need to access freezer compartment 124. In the exemplary embodiment, dispenser 114 is positioned at a level that approximates the chest level of a user.

Refrigerator appliance 100 may also include features for generating heated liquid water and/or steam and directing such heated liquid water and/or steam to dispenser recess 168. Thus, refrigerator appliance 100 need not be connected to a residential hot water heating system in order to supply heated liquid water and/or steam to dispenser recess 168. In particular, refrigerator appliance 100 includes a water heating assembly 160 mounted within refrigerator door 128 for heating water therein. Refrigerator appliance 100 may include a tee joint 162 for splitting a flow of water. Tee-joint 162 directs water to both a heated water conduit 166 and a chilled water conduit 164.

Heated water conduit 166 is in fluid communication with water heating assembly 160 and heated water outlet 150. Thus, water from tee joint 162 can pass through water heating assembly 160 and exit refrigerator appliance 100 at heated water outlet 150 as heated liquid water or steam. Conversely, chilled water conduit 164 is in fluid communication with chilled water outlet 132. Thus, water from tee-joint 162 can exit refrigerator appliance 100 as chilled liquid water at chilled water outlet 132. In alternative exemplary embodiments, chilled water conduit 164 and heated water conduit 166 are joined such that chilled and heated water conduits 164 and 166 are connected in parallel or in series to each other and dispense fluid at dispenser recess 168 from a common outlet.

Operation of the refrigerator appliance 100 can be regulated by a controller 170 that is operatively coupled to user interface panel 138 and/or various sensors as discussed below. User interface panel 138 provides selections for user manipulation of the operation of refrigerator appliance 100 such as e.g., selections between whole or crushed ice, chilled water, and/or other various options. In response to user manipulation of the user interface panel 138 or sensor signals, controller 170 may operate various components of the refrigerator appliance 100. Controller 170 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 170 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Controller 170 may be positioned in a variety of locations throughout refrigerator appliance 100. In the illustrated embodiment, controller 170 is located within the user interface panel 138. In other embodiments, the controller 170 may be positioned at any suitable location within refrigerator appliance 100, such as for example within a fresh food chamber, a freezer door, etc. Input/output ("I/O") signals may be routed between controller 170 and various operational components of refrigerator appliance 100. For example, user interface panel 138 may be in communication with controller 170 via one or more signal lines or shared communication busses.

Referring now to FIGS. 2 through 6, various embodiments of dispensing assembly 110 are illustrated. As discussed above, apparatus for dispensing single serve beverages from refrigerator appliances 100 are desired. Accordingly, the present disclosure is further directed to such apparatus.

As discussed herein, refrigerator appliance 100 may be utilized with single serve dispensers 200. A single serve dispenser 200 is generally a container which contains a predetermined amount of a substance to be mixed with a suitable liquid such as water. For example, coffee, tea, chocolate, or other suitable consumable or non-consumable substances may be contained within the dispenser 200. A top cover 202 may enclose an opening of the container, and may be puncturable and/or removable to access the substance therein. For example, in some embodiments, the top cover 202 may be formed from a suitable foil material, such as aluminum foil. Dispenser 200 may additionally include a lip 204, which may facilitate placing the dispenser in a housing, as discussed below, such as by sliding the dispenser into the housing. A liquid may then be introduced into the dispenser 200, and the liquid and substance may then flow from the dispenser 200 into, for example, a container (not shown) typically placed below the dispenser 200.

As shown, a dispensing assembly 110 may include an outlet conduit 210. The outlet conduit 210 may be configured for flowing a liquid therefrom. In some embodiments, for example, outlet conduit 210 may be a portion of heated water conduit 166, such as heated water outlet 150, or a portion of chilled water conduit 164, such as chilled water outlet 132. Alternatively, the outlet conduit 210 may be independent from such conduits. The outlet conduit 210 may generally be disposed in the dispenser recess 168, as illustrated.

In exemplary embodiments, the outlet conduit 210 may flow a heated liquid, such as heated water, therethrough. For example, as discussed above, water can pass through a water heating assembly 160 and be heated therein, such that it flows from outlet conduit 210 as heated liquid water or steam. Thus, dispensing assembly 110 may include a heating element 212, which may for example, be disposed in water heating assembly 160 as illustrated, for heating the liquid before the liquid is flowed from the outlet conduit 210.

As further illustrated, a housing 220 may be provided for supporting the single serve dispenser 200. The housing 220 may also be disposed in the dispenser recess 168, as shown. The housing 220 may, for example, include a platform 222 which defines a recess 224 therein, into which a single serve dispenser 200 may be placed. For example, the lip 204 of the dispenser 204 may be slid into the recess 224, and the remainder of the dispenser 200 may generally hang from the platform 200. In some embodiments, various sidewalls may additionally be included in the housing 220, and may extend from the platform to surround the dispenser 200 on various sides.

Additionally, in some embodiments, user interface panel 140 may further define the dispenser recess 168. As shown, panel 140 may for example extend from the dispenser 114, such as in the generally vertical direction V, such that a portion of the recess 168 is defined behind the panel 140. Additionally, panel 140 may serve to hide various other components, such as the outlet conduit 210, housing 220, and/or various components thereof in various positions as discussed herein. For example, from a point-of-view in the transverse direction T, a user may view the panel 140 but not be able to see such components hidden behind the panel 140 when in various positions, as discussed herein.

One or both of the outlet conduit 210 and housing 220 according to the present disclosure are movable. Specifically, as shown, one or both of the outlet conduit 210 and housing 220 may be movable along a direction towards (and conversely away from) the other of the outlet conduit 210 and housing 220. Such movement in exemplary embodiments may along the generally vertical direction V. Such movement may facilitate use of the single serve dispenser 200, by allowing the dispenser 200 to be loaded in the housing 220 and then provided with liquid from the outlet conduit 210. For example, such movement may bring the outlet conduit 210 and dispenser 200 in contact, such that for example the outlet conduit 210 may puncture or otherwise penetrate the top cover 202. Liquid may then be flowed from the outlet conduit 210 into the dispenser 200 as required.

Controller 170 may be in communication with one or both of the outlet conduit 210 and housing 220, and may be operable to move the one or both of the outlet conduit 210 and housing 220 as desired, such as long the generally vertical direction. For example, in some embodiments, the controller 170 may be operable cause such movement based on a user input, such as via a user interacting with user interface panel 140. Additionally or alternatively, the controller 170 may be automatically operable based on sensing of the single serve dispenser 200 supported on the housing 220. A sensor 226 may be provided for sensing whether a dispenser 200 is disposed in the housing 220. Sensor 226 may in some embodiments as shown be included in outlet conduit 210 or housing 220. One or both of the outlet conduit 210 and housing may be initially moved away from each other, to for example allow for loading of a dispenser 200 in the housing 220. When a dispenser 200 is placed in the housing 220, for example, the sensor 226 may detect the presence of the dispenser 200 and communicate this to the controller 170, which may instruct one or both of the outlet conduit 210 and housing 220 to move towards each other, to for example bring the outlet conduit 210 and dispenser 200 in contact. Further, when the outlet conduit 210 has for example completed the liquid flow therethrough into the dispenser 200, the controller 170, sensor 226 or another suitable sensor (such as a sensor connected to the outlet conduit 210) may detect such completion. This may be communicated to the controller 170 and/or the controller 170 may instruct one or both of the outlet conduit 210 and housing 220 to move away from other, to for example allow for removal of the dispenser 200 from the housing 220. When a dispenser 200 is removed from the housing 220, for example, the sensor 226 may detect the absence of the dispenser 200 and communicate this to the controller 170, which may instruct one or both of the outlet conduit 210 and housing 220 to move towards each other, to for example retract the outlet conduit 210 and/or housing 220 such that they are, for example, not visible. Alternatively, such various movements may be performed due to a user selecting various user inputs on the user interface panel 140.

It should be understood that the various movements of the various components as discussed herein may be performed based on user input and/or performed automatically. For example, all steps may be performed via user input, or automatically, or through a combination of user inputs and automatic steps. In one exemplary embodiment, for example, a user input facilitates an initial movement before or after a dispenser 200 is placed on a housing 220 and the remaining movements are performed automatically.

Figure 2:
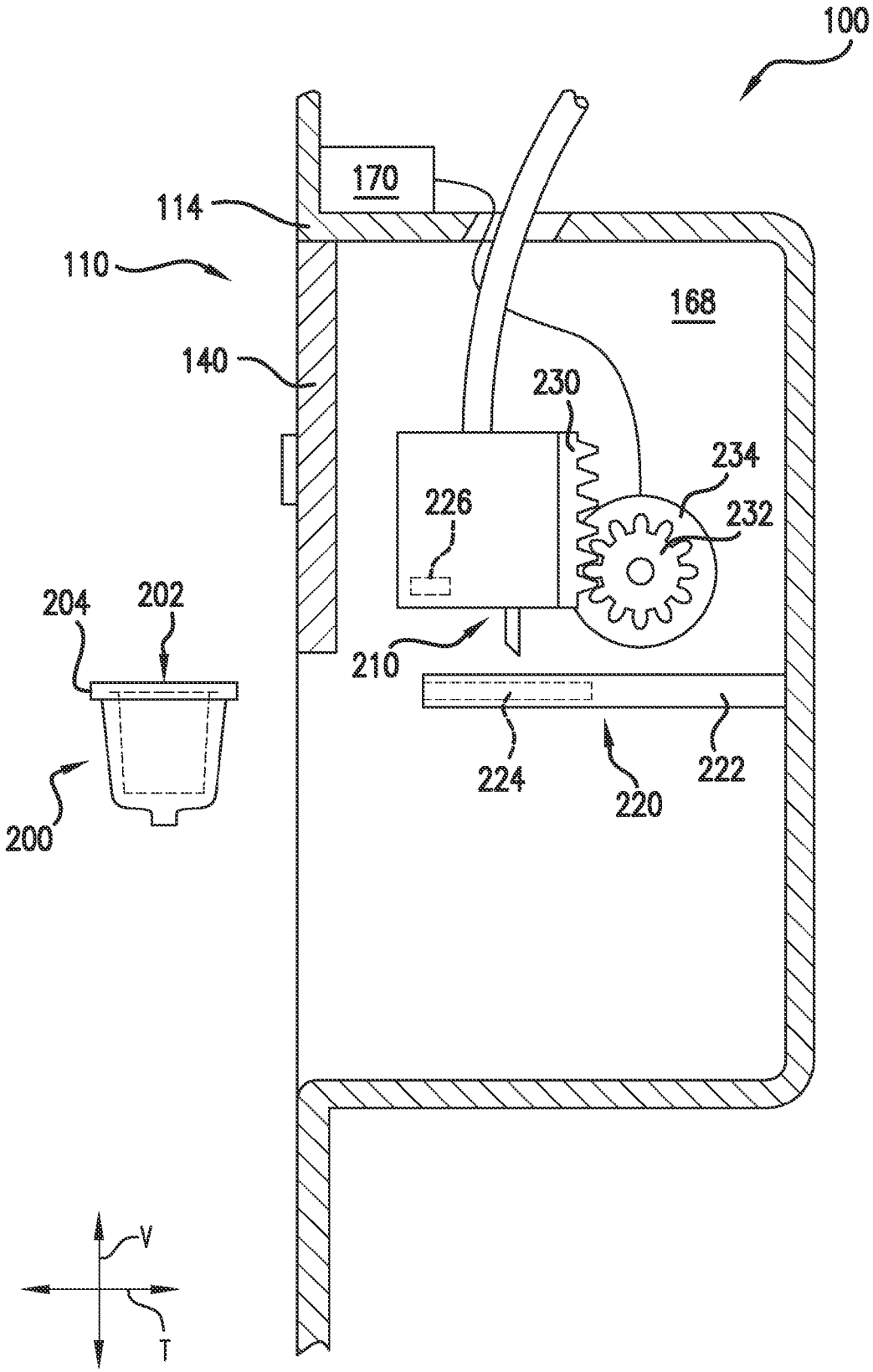
FIG. 2 illustrates a dispensing assembly of a refrigerator apparatus according to one embodiment of the present disclosure, with an outlet conduit in a non-dispensing position.
Figure 3:
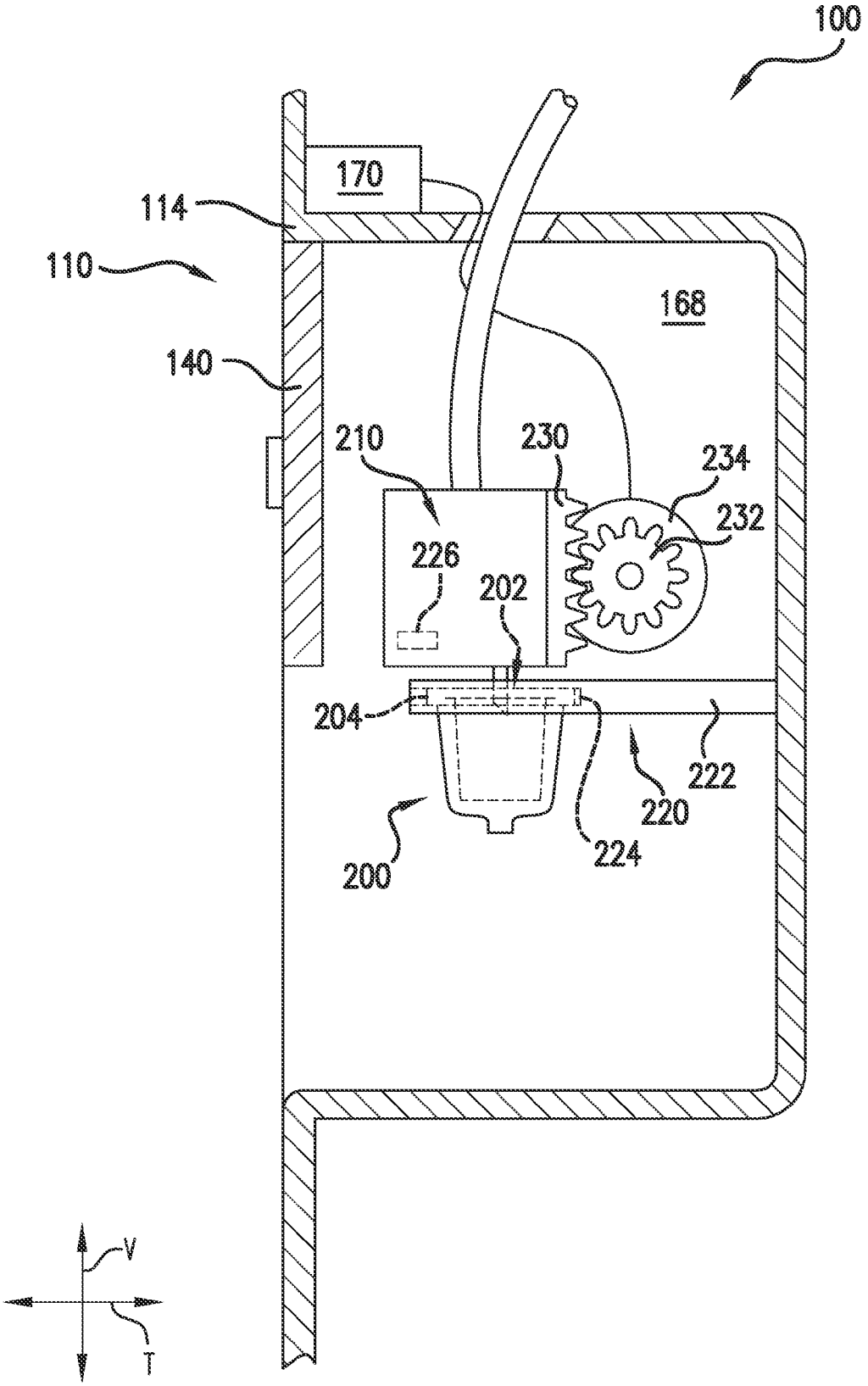
FIG. 3 illustrates the dispensing assembly of FIG. 2 with the outlet conduit in a dispensing position.

FIGS. 2-3 illustrate one embodiment of the present disclosure, wherein the outlet conduit 210 is movable. As shown, outlet conduit 210 in these embodiments may include a rack 230, and a mating pinion gear 232 mounted to a motor 234 which in turn is in communication with the controller 170 may be provided. Operation of the motor 234 via commands from the controller 170 may move the outlet conduit 210 as desired. It should be understood that the present disclosure is not limited to such rack-and-pinion embodiments, and rather that any suitable mechanical apparatus may be utilized to facilitate movement of the outlet conduit 210.

FIG. 2 illustrates the outlet conduit 210 in a non-dispensing position. As shown, the dispenser 200 is not loaded in the housing 220, and the outlet conduit 210 and housing are spaced apart. FIG. 3 illustrates the outlet conduit 210 in a dispensing position. As shown, the dispenser 200 is loaded in the housing 220, and the outlet conduit 210 is moved towards the housing 220 such that the outlet conduit 210 is in contact with the dispenser 200. After the liquid is flowed through the outlet conduit 210, the outlet conduit 210 may then be moved away from the housing 220 to allow removal of the dispenser 200.

Figure 4:
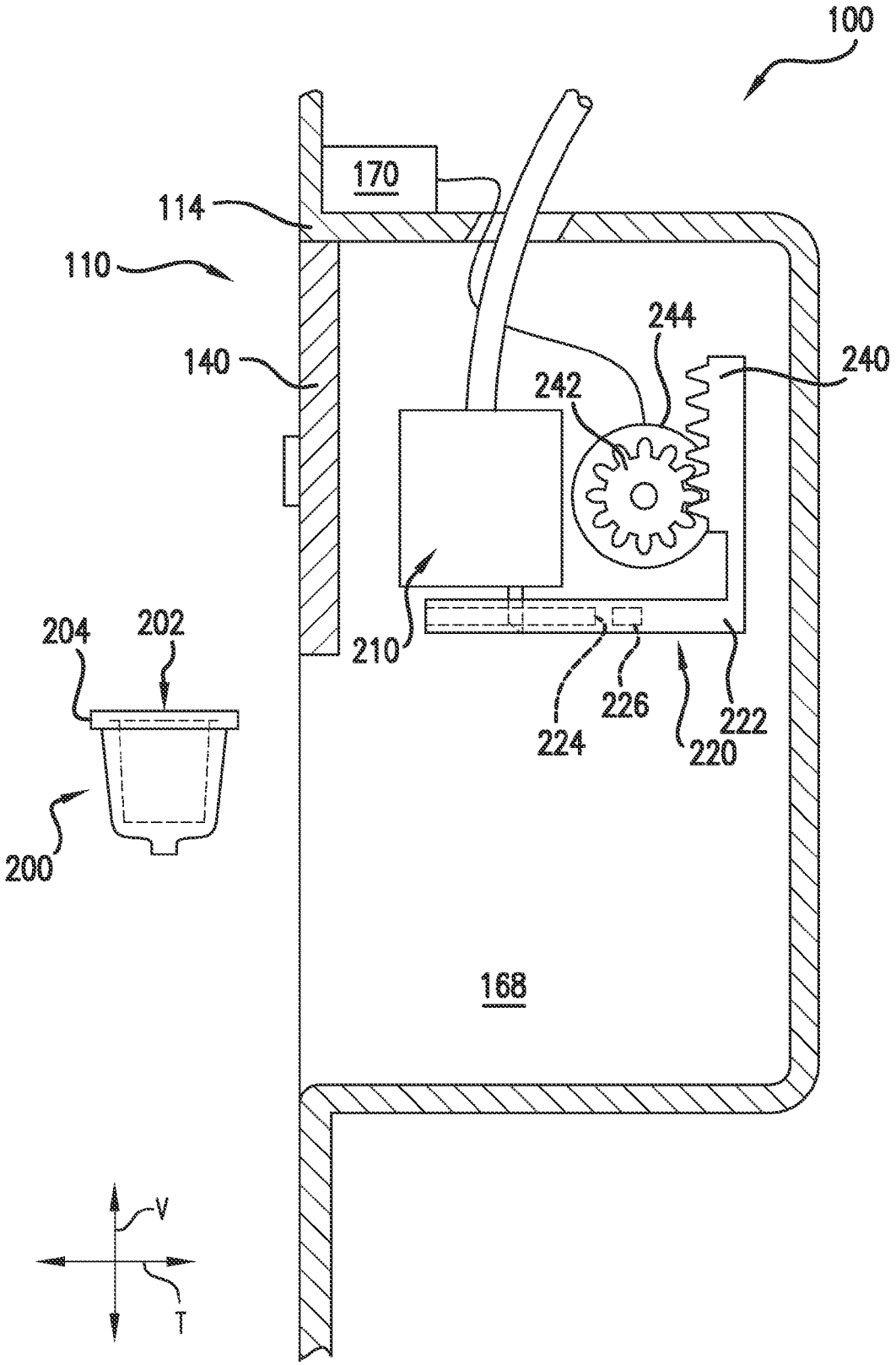
FIG. 4 illustrates a dispensing assembly of a refrigerator apparatus according to another embodiment of the present disclosure, with a housing in a non-dispensing position.
Figure 5:
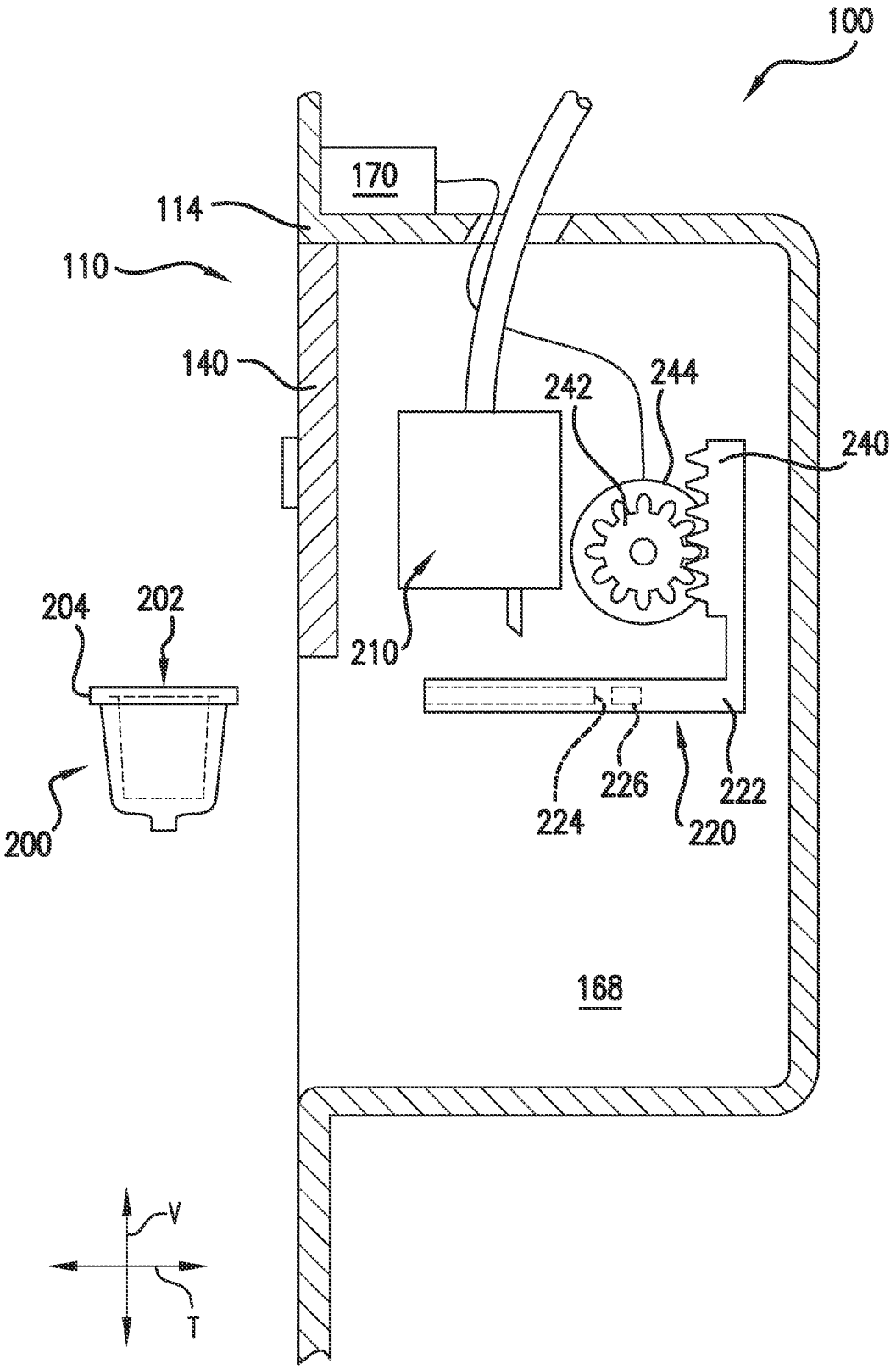
FIG. 5 illustrates the dispensing assembly of FIG. 4 with the housing in a loading position.
Figure 6:
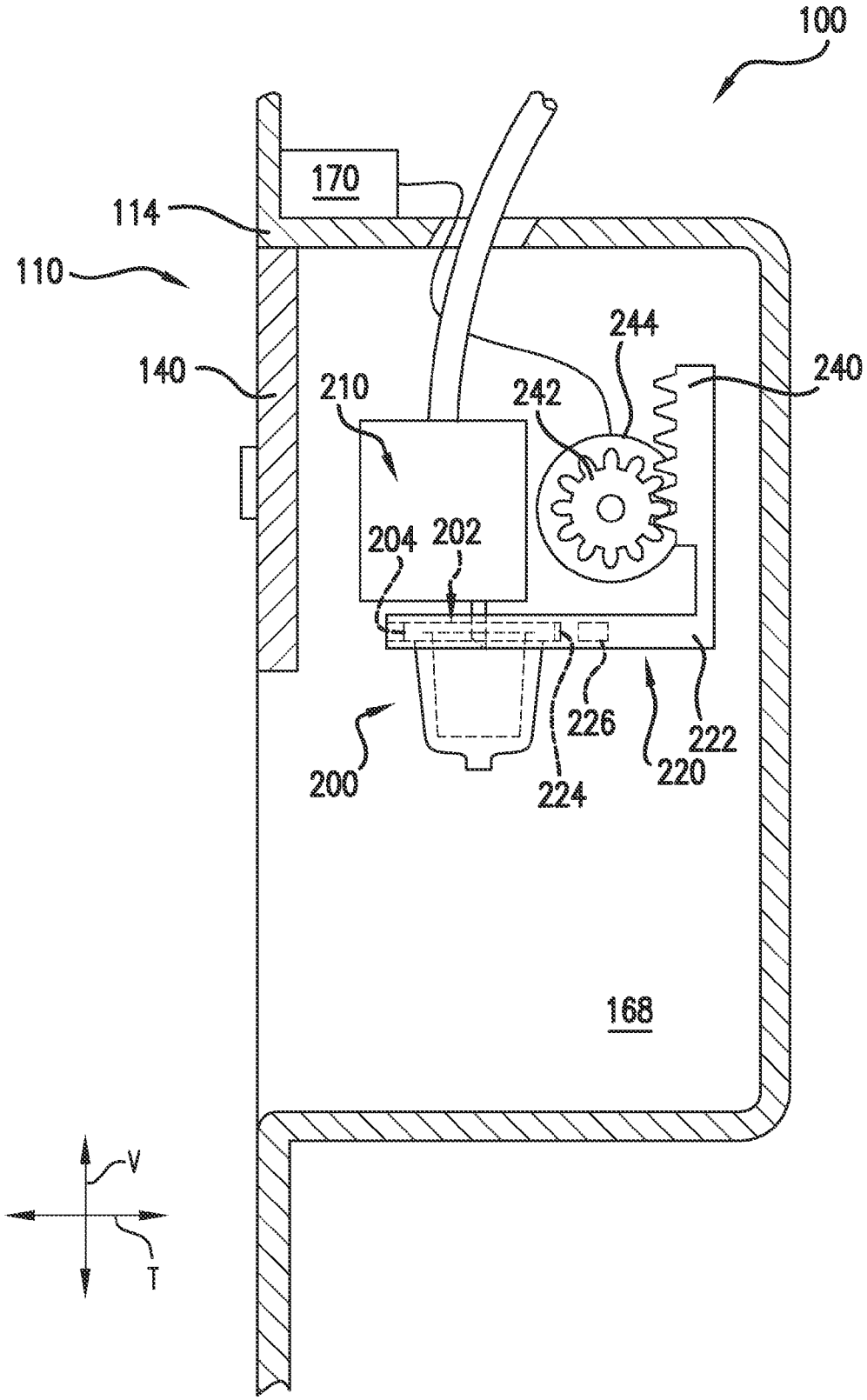
FIG. 6 illustrates the dispensing assembly of FIG. 4 with the housing in a dispensing position.

FIGS. 4-6 illustrate another embodiment of the present disclosure, wherein the housing 220 is movable. As shown, housing 220 in these embodiments may include a rack 240, and a mating pinion gear 242 mounted to a motor 244 which in turn is in communication with the controller 170 may be provided. Operation of the motor 244 via commands from the controller 170 may move the housing 220 as desired. It should be understood that the present disclosure is not limited to such rack-and-pinion embodiments, and rather that any suitable mechanical apparatus may be utilized to facilitate movement of the housing 220.

FIG. 4 illustrates the housing 220 in a non-dispensing position. As shown, the dispenser 200 is not loaded in the housing 220, and the housing 220 is moved towards outlet conduit 210 such that it is generally retracted within the recess 168. Notably, when retracted, the housing 220 may be generally hidden behind the user interface panel 140, as discussed above, such that users advantageously do not have to view the housing 220 when not in use. Alternatively, however, the housing in the non-dispensing position may be moved away from the outlet conduit 210. FIG. 5 illustrates the housing 220 in a loading position. As shown, the housing 220 is moved away from the outlet conduit 210 to facilitate loading of the dispenser 200. In alternative embodiments, the loading position may be the same as the non-dispensing position. FIG. 6 illustrates the housing 220 in a dispensing position. As shown, the dispenser 200 is loaded in the housing 220, and the housing 220 is moved towards the outlet conduit 210 such that the outlet conduit 210 is in contact with the dispenser 200. After the liquid is flowed through the outlet conduit 210, the outlet conduit 210 may then be moved away from the housing 220 to allow removal of the dispenser 200. Further, in some embodiments, after removal of the dispenser 200, the housing 220 may retract into the non-dispensing position.

The present disclosure may further be directed to methods for operating refrigerator appliances. For example, a method may include providing a single serve dispenser 200 in a housing 220, as discussed herein. The method may further include moving one or both of the housing 220 or an outlet conduit 210 such that the outlet conduit 210 contacts the single serve dispenser 200, as discussed herein. The method may further flowing a liquid from the outlet conduit 210 into the single serve dispenser 200, as discussed herein.

In some exemplary embodiments, the moving step is performed in a generally vertical direction. Further, the moving step may be performed based on user inputs and/or automatically after the providing step.

In some embodiments, a method according to the present disclosure may further include, after flowing the liquid, moving one or both of the housing 220 or the outlet conduit 210 oppositely, such as along the generally vertical direction, as discussed herein. Additionally or alternatively, a method according to the present disclosure may include, before the providing step, moving one or both of the housing 220 or the outlet conduit 210 oppositely, such as along the generally vertical direction, as discussed herein. Still further, in some embodiments, a method according to the present disclosure may include heating the liquid, such as before the liquid is flowed from the outlet conduit 210, as discussed herein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance for use with a single serve dispenser, comprising:

a cabinet defining a chilled chamber for receiving food or beverage items for storage, the cabinet defining an opening for accessing the chilled chamber;

a door mounted to the cabinet at the opening of the cabinet, the door defining a dispenser recess;

a dispensing assembly, the dispensing assembly comprising:

an outlet conduit configured for flowing a liquid therefrom, the outlet conduit disposed in the dispenser recess; and a housing for supporting the single serve dispenser, the housing disposed in the dispenser recess;

wherein the housing is movable along a direction towards the outlet conduit, and a controller in communication with the housing, the controller operable to move the housing.

2. The refrigerator appliance of claim 1, wherein the housing is movable along a generally vertical direction.

3. The refrigerator appliance of claim 1, wherein the housing is further movable along the direction away from the outlet conduit.

4. The refrigerator appliance of claim 1, further comprising a user interface panel having at least one user input, the user interface panel further defining the dispenser recess.

5. The refrigerator appliance of claim 1, wherein the controller is operable based on a user input.

6. The refrigerator appliance of claim 1, wherein the controller is automatically operable based on sensing of the single serve dispenser supported on the housing.

7. The refrigerator appliance of claim 1, wherein the housing is movable along the generally vertical direction.

8. The refrigerator appliance of claim 1, wherein the housing is movable along the generally vertical direction such that the outlet conduit contacts the single serve dispenser supported by the housing.

9. The refrigerator appliance of claim 1, wherein the dispensing assembly further comprises a heating element configured for heating the liquid before the liquid is flowed from the outlet conduit.

* * * * *